US006252562B1

(12) United States Patent
Diez

(10) Patent No.: US 6,252,562 B1
(45) Date of Patent: Jun. 26, 2001

(54) ANTENNA FOR ORBITING SATELLITE

(75) Inventor: Hubert Diez, Leguevin (FR)

(73) Assignee: Centre National d'Etudes Spatiales, Paris (FR)

( * ) Notice: Subject to any disclaimer, the term of this patent is extended or adjusted under 35 U.S.C. 154(b) by 0 days.

(21) Appl. No.: 09/381,537

(22) PCT Filed: Mar. 17, 1998

(86) PCT No.: PCT/FR98/00535

§ 371 Date: Sep. 17, 1999

§ 102(e) Date: Sep. 17, 1999

(87) PCT Pub. No.: WO98/42042

PCT Pub. Date: Sep. 24, 1998

(30) Foreign Application Priority Data

Mar. 17, 1997 (FR) ..... 97 03250

(51) Int. Cl.[7] ..... H01Q 1/36
(52) U.S. Cl. ..... 343/895; 343/853; 342/375
(58) Field of Search ..... 343/895, 844, 343/DIG. 2, 853, 754; 342/372, 373, 375

(56) References Cited

U.S. PATENT DOCUMENTS 4,989,011 * 1/1991 Rosen et al. ..... 342/373
5,041,842 8/1991 Blaese ..... 343/882
5,258,771 * 11/1993 Praba ..... 343/895
5,345,248 9/1994 Hwang et al. ..... 343/895
5,986,619 * 11/1999 Grybos et al. ..... 343/895

OTHER PUBLICATIONS

Imbriale Et al.: "An S–Band Phased Array For Multiple Access Communications" NTC77 Conference Record, vol. 2, 1977 vol. 2, 1977.

Glockler: "Phased Array For Millimeter Wave Frequencies" International Journal of Infrared and millimeter Waves., vol. 11, No. 2 Feb. 1990 pp. 101–110.

* cited by examiner

*Primary Examiner*—Tan Ho
(74) *Attorney, Agent, or Firm*—Blakely, Sokoloff, Taylor & Zafman

(57) ABSTRACT

An orbiting satellite system with an antenna for re-transmitting to the ground images collected by image capture instruments of the satellite, the antennas having more than one elementary radiating antenna each of which has more than one cord regularly distributed in a helix about a generatrix of revolution and equi-amplitude power supply for the various cords where the axis of the various elementary antenna are parallel and aligned in one and the same plane in which they are spaced regularly apart in that plane. The plane of the antennas is intended to align with, when the satellite is in orbit, the direction perpendicular to the direction of the speed vector of the satellite. The antenna also has a phase shifting power supply which enables the antenna array to carry out electronic steering of the elongate beam generated by the elementary array.

29 Claims, 5 Drawing Sheets

ANTENNA FOR ORBITING SATELLITE

BACKGROUND OF THE INVENTION

1. Field of the Invention

The present invention relates to antennas for orbiting satellites.

2. Description of the Related Art

Hitherto, the antennas used by orbiting satellites are either antennas of the omnidirectional type (SPOT, ERS, etc.) or of the steerable directional type (LANDSAT, etc.).

In the latter case, the beam is Gaussian and scanning is carried out with the aid of a pointing mechanism, the antenna itself behaving as a centered parabolic reflector of conventional design.

SUMMARY OF THE INVENTION

One purpose of the invention is to propose an antenna for orbiting satellite which requires no pointing mechanism, which exhibits a greater gain than omnidirectional antennas and which is compact and inexpensive.

To this end, the invention proposes an antenna for retransmitting to the ground images collected by image-capture instruments of an orbiting satellite, characterized in that it comprises a plurality of elementary radiating antennas of the type having a plurality of cords regularly distributed in a helix about one and the same generatrix of revolution as well as means for the equi-amplitude power supply of the various cords, in that these various elementary antennas are aligned and in that the plane in which these various elementary antennas are distributed is intended, when the satellite is in orbit, to be perpendicular to the direction of the speed vector of the satellite and in that it also comprises means for phase-shifting the power supply to these various elementary antennas which are able to carry out electronic steering of the elongate beam generated by the said elementary antennas.

It will be noted that with such a distribution of elementary antennas with a shaped pattern, the transmit beam produced is a beam of elliptic type (known as "fan beans" [sic]) which extends in a direction parallel to that of the speed vector of the satellite.

The steering of this beam to a given longitude makes it possible to reach, throughout the time of transit of a satellite, a station located at this longitude, and to do so without needing to modify this steering as the satellite advances.

It is understood that such an antenna structure does not require complicated electronics and allows high transmission bit rates.

This antenna is advantageously supplemented with the following various characteristics taken alone or according to all their possible combinations:

- the number of elementary radiating elements is equal to or greater than five;
- the elementary radiating elements are staggered one with respect to another with a spacing which is chosen so as to avoid the grating lobes;
- for a transmission frequency of 8000 MHz, the spacing between two elementary antennas is of the order of 19 mm;
- the phase-shifting means are coded over three to eight bits;
- the phase-shifting means are of the ferrite type.

Other characteristics and advantages of the invention will emerge further from the following description. This description is purely illustrative and nonlimiting. It should be read in conjunction with the appended drawings in which:

DETAILED DESCRIPTION OF THE INVENTION

Figure 1:
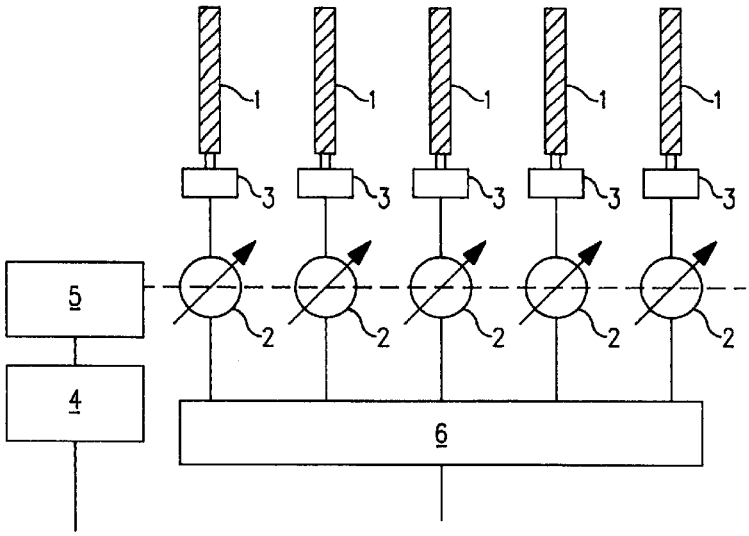
FIG. 1 is a schematic representation illustrating an antenna in accordance with one embodiment of the invention.

The antenna illustrated in FIG. 1 comprises a plurality of elementary radiating elements referenced by 1.

These elementary radiating elements 1 each comprise a plurality of helical cords regularly distributed about one and the same generatrix of revolution. The generatrix is for example conical or cylindrical. These cords are powered in an equi-amplitude manner.

For example, these cords are four in number and define four identical helices, staggered by $\pi/2$ with respect to one another. These four cords are advantageously phase-quadrature-powered.

Figure 2:
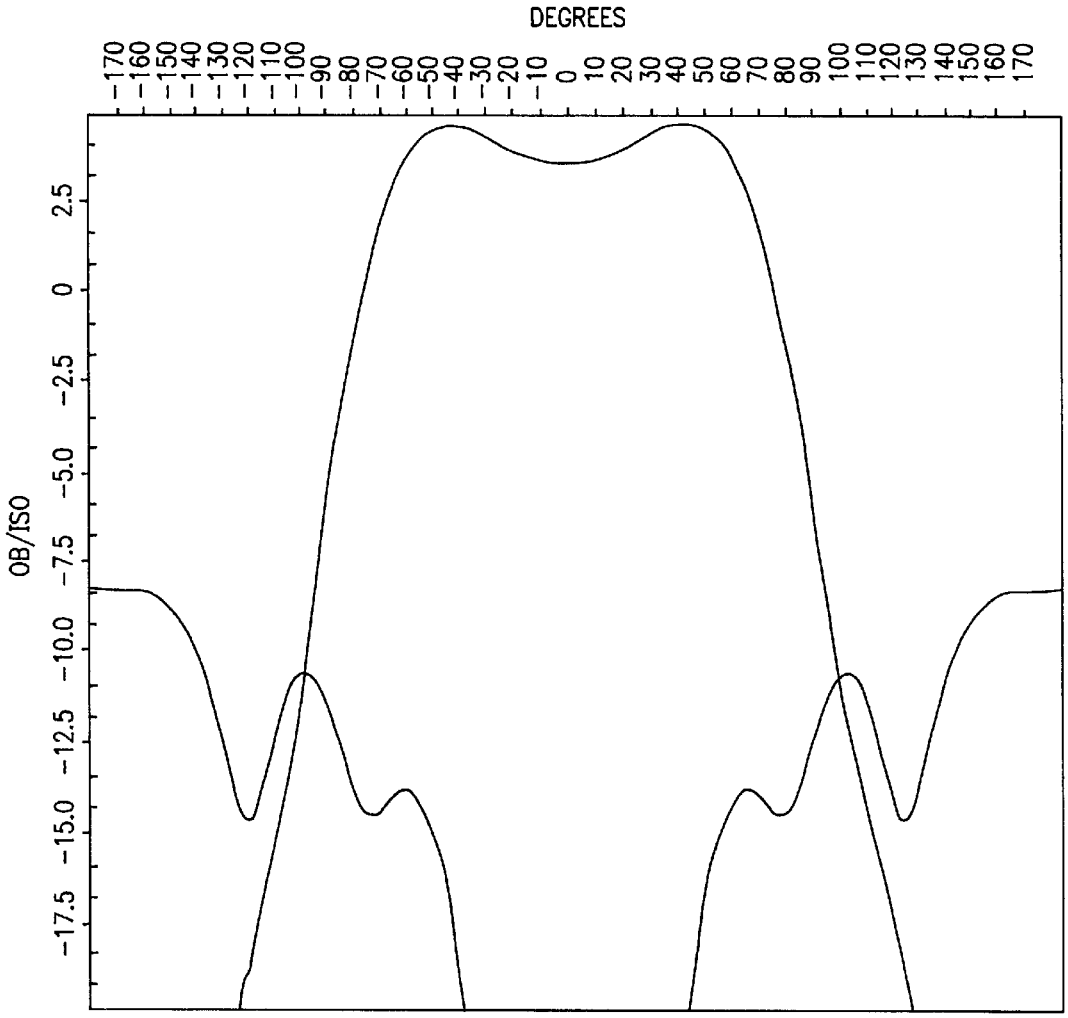
FIG. 2 is a graph on which has been plotted the pattern of an elementary radiating element of the antenna of FIG. 1.

The angular radiating pattern of such an elementary radiating element is of the type illustrated in FIG. 2.

This pattern corresponds to the pattern obtained for an axial height of radiating element of 0.050 m, a base radius of 0.018 m, and a transmission frequency of 8000 MHz. It is referred to a measurement sphere 10 mm in diameter.

It will be noted that the elementary radiating elements with several helical cords have, as will be seen later, the advantage of exhibiting greater gains at 500 than at 0° and hence of making it possible to compensate for steering losses.

The elementary radiating elements 1 are distributed in line in a plane perpendicular to the direction of the speed vector.

They are arranged in such a way that their axes are parallel, in one and the same plane and spaced regularly apart. The spacing between the said radiating elements 1 is for example 19 mm for a transmission frequency of 8000 MHz, thereby preventing grating lobes.

More generally, the spacing d of the array is such that $$d<\lambda/(1+\sin\theta)$$

where $\lambda$ is the wavelength of the radiation, and $\theta$ the maximum amount of steering desired.

The radiating elements 1 are powered via phase-shifters 2 of ferrite type and couplers 3, through a power distributor 6 (in this instance 1:5), which is for example of waveguide type.

The phase-shifters 2 are controlled by a unit 4 which is the satellite on-board computer, to which unit they are linked by control electronics 5.

The use of ferrite type phase-shifters has the advantage of making it possible always to retain the same amount of steering. The consumption of the control electronics is then limited.

The phase shifts imposed on the various radiating elements 1 make it possible to produce the desired amounts of steering, up to ±62°.

The choice of a helix structure for the radiating elements 1 makes it possible to attain a gain at 500 which is 2 dB greater than the gain at 0° (excluding the term for compensating for difference in space attenuation −62° satellite up with respect to the zenith) and hence to compensate naturally for the steering losses.

The optimal number of elementary radiating elements will vary from five to twelve depending on the requirements of the mission.

The phase-shifters 2 have for example quantization spacings of 22.50 and are coded over 4 bits.

The beams generated by such an antenna are elliptic (major axis of the ellipses parallel to the track of the satellite).

Figure 3:
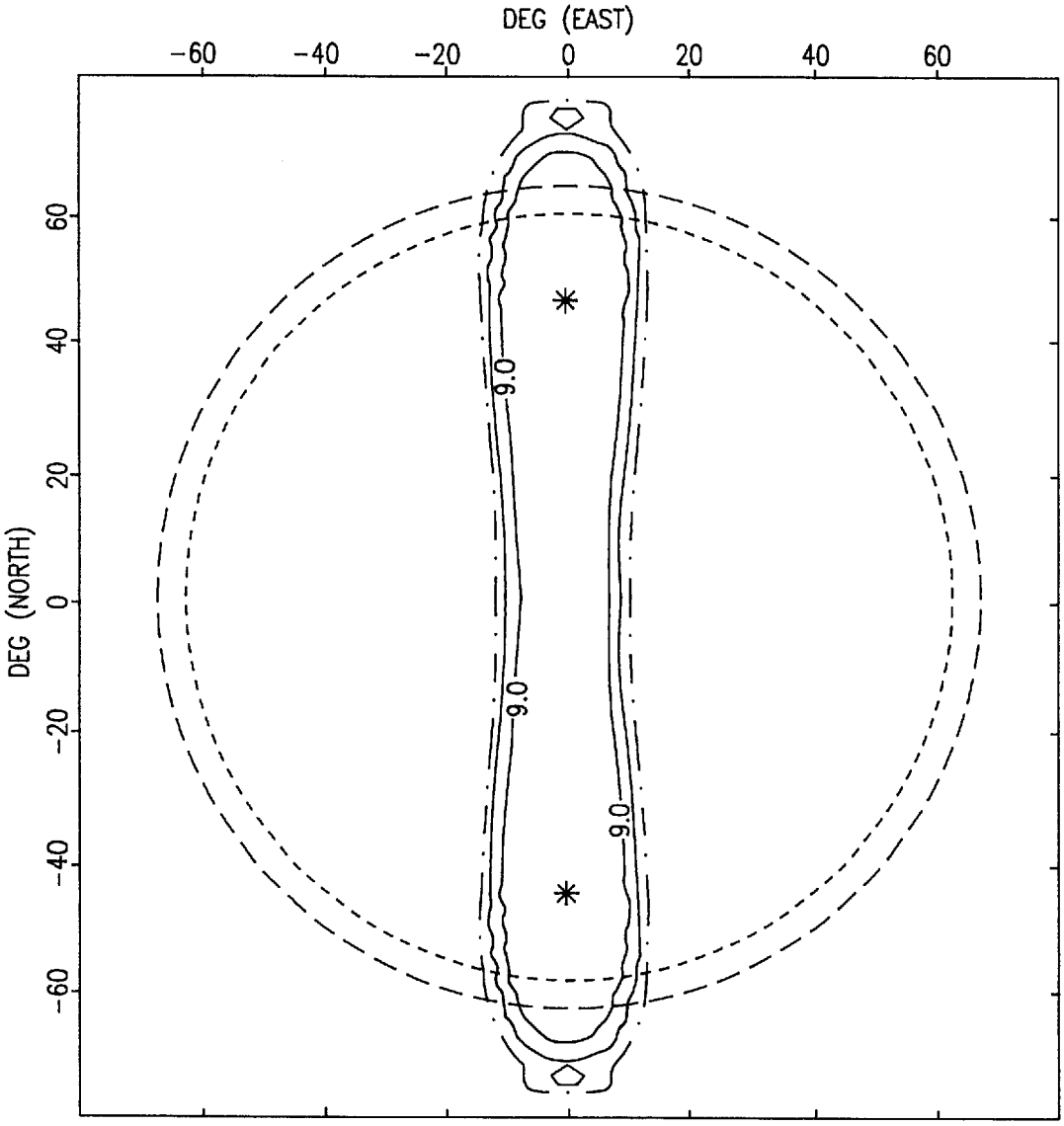
FIGS. 3 to 6 illustrate various coverage patterns obtained with the antenna of FIG. 1.

FIG. 3 illustrates the coverage obtained with the antenna just described, in the case of a zero phase shift between the various radiating elements 1.

There is then no steering and the maximum directivity of the antenna is 11.55 dB.

Figure 4:
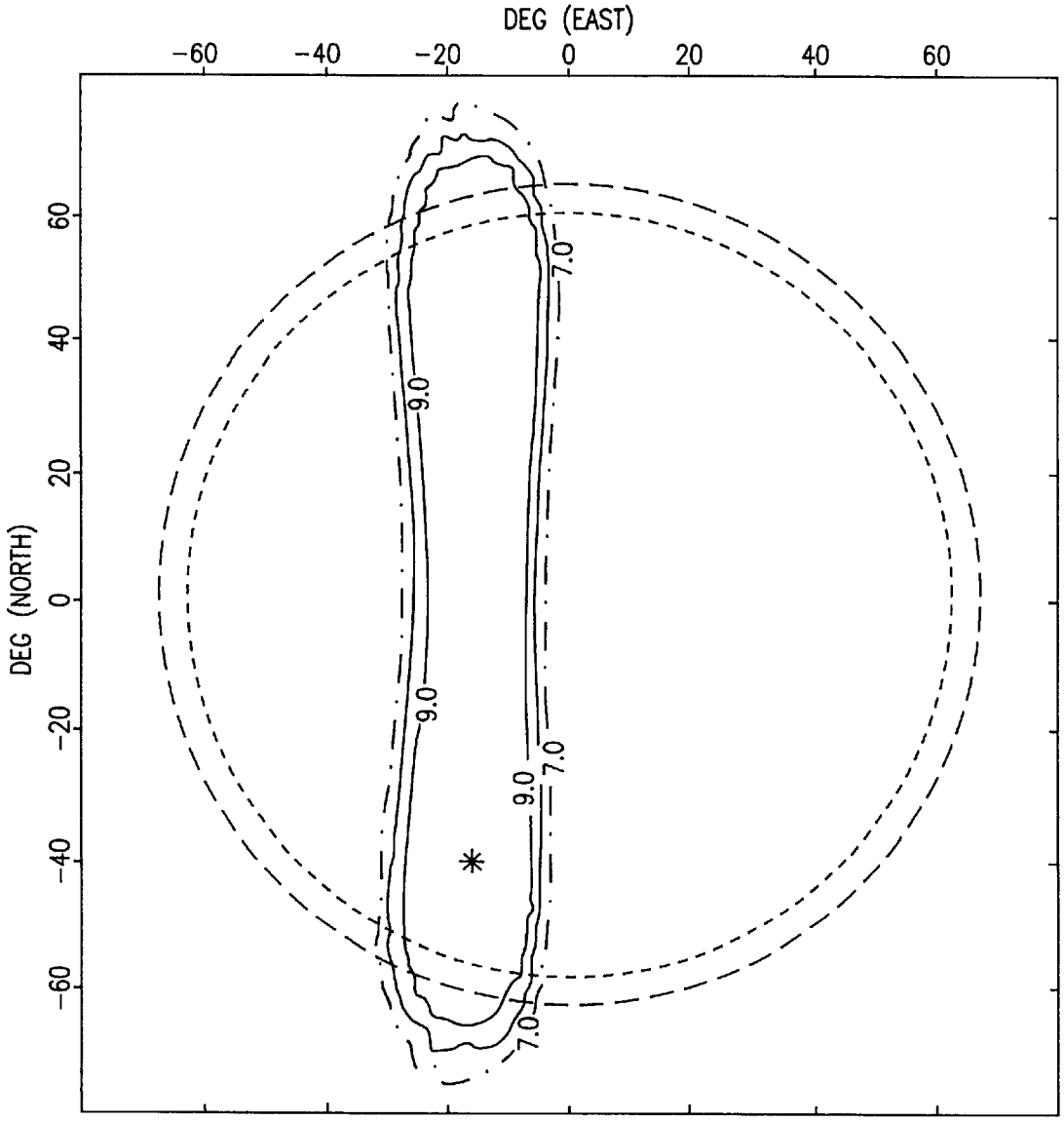

Represented in FIG. 4 is the coverage obtained in the case of phase shifts respectively from one end radiating element 1 to the other of 90°, 45°, 0°, −45° and −90°.

The pattern is then steered by +18°. The directivity is 11.52 dB.

Figure 5:
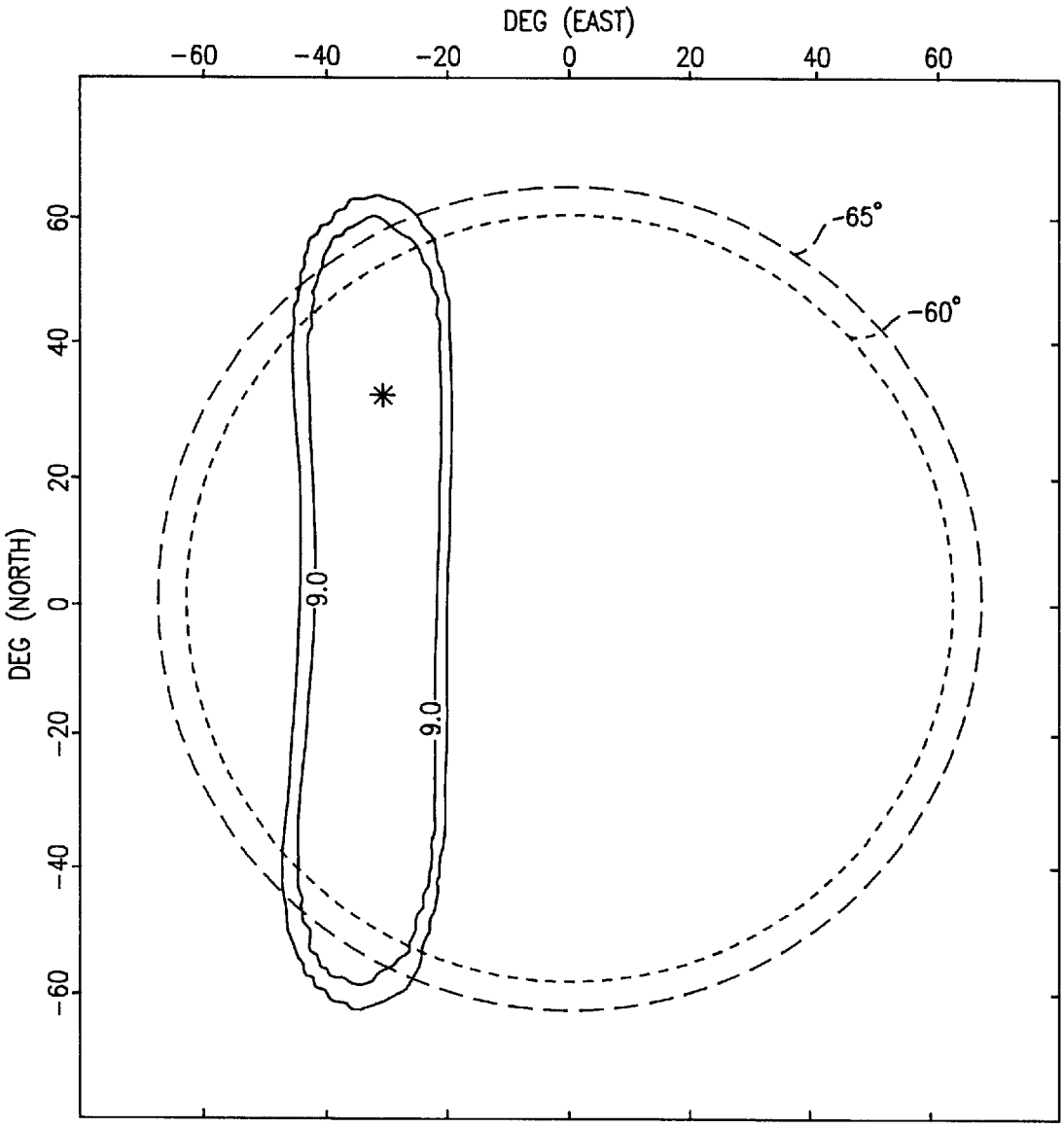

Illustrated in FIG. 5 is the coverage obtained in the case of a phase shift of 180°, 90°, 0°, −90°, −180°, respectively.

The steering is then 320, the directivity 11.49 dB.

Figure 6:
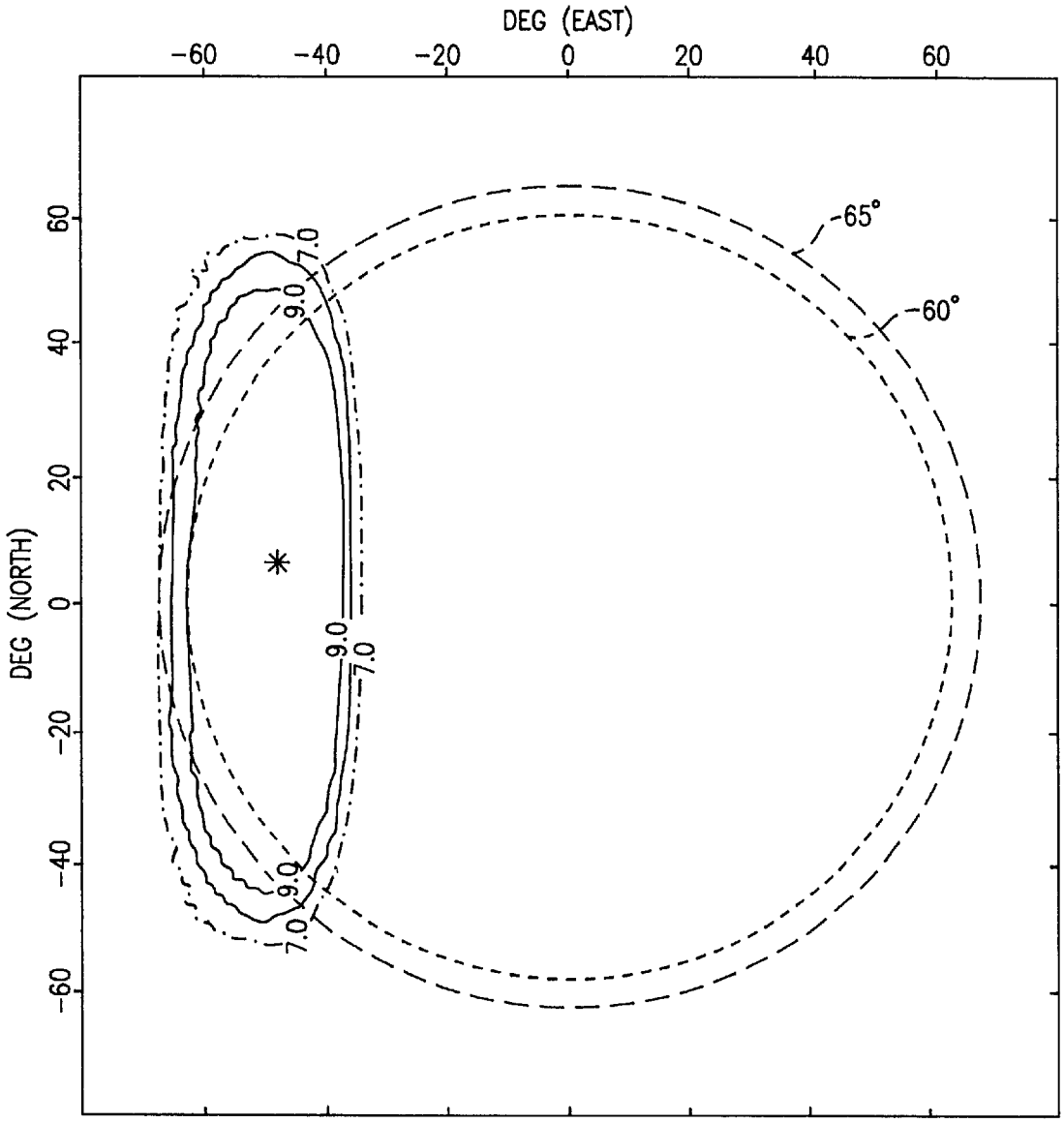

Finally, represented in FIG. 6 is the coverage obtained for phase shifts of 270°, 135°, 0°, −135° and −270°, respectively.

The steering obtained is 48°, the maximum directivity 11.45 dB.

In these various FIGS. 3 to 6, the circles represented by dashed lines correspond to the circles of visibility at ±60° and ±65°, respectively.

It is noted that, from one pattern to another, the maximum directivity varies very little (11.54 dB to 11.45 dB).

The directivity obtained at 650 is greater than 9-dB [sic], i.e. a gain of greater than 7.5 dB if losses of 0.5 dB are considered with regard to the distributors, of 0.5 dB with regard to the phase-shifters, of 0.25 dB with regard to the connection facilities and of 0.25 dB with regard to the power supply.

The steerable antenna just described allows considerable bit rates for retransmission to the ground and allows retransmissions of high-resolution images.

The switching of the beam is preferably performed before transit, so as to avoid the problems of phase hopping over the coverage generated.

In the case where the antenna pattern does not compensate for the space attenuation, it is possible to envisage changes of transmission speed so as to make best use of the gains of the antenna in areas close to the zenith transit.

The steerable antenna just described has the advantage of being inexpensive and especially of small proportions. The proportions of the radiating part are 90 mm long, 5 mm wide and 50 mm high.

Again advantageously, the antenna comprises several in-line antennas of the type just described, and switching means making it possible to switch over from one in-line antenna to another as a function of the movements of the satellite, and in particular of its roll movements.

As a variant, the antenna comprises motorization means which make it possible to modify the orientation of the line or lines of elementary radiating elements so as to compensate for the potential movements of the satellite, in particular its roll movements.

What is claimed is:

1. A system comprising:

an orbiting satellite and an antenna for retransmitting to the ground images collected by image-capture instruments of said satellite, wherein said antenna comprises;

a plurality of elementary radiating antennas (1) of the type having a plurality of cords regularly distributed in a helix about one and the same generatrix of revolution as well as means for the equi-amplitude power supply of said cords, in that the axes of said plurality of elementary antennas are parallel to each other and are aligned in one and the same plane in which they are spaced regularly apart in that said plane in which said elementary antennas are distributed is intended, when said satellite is in orbit, to be perpendicular to the direction of the speed vector of said satellite and in that said antenna also comprises means (2) for phase-shifting the power supply to said elementary antennas which are able to carry out electronic steering of the elongate beam generated by said elementary antennas.

2. The system according to claim 1, wherein the number of elementary radiating elements (1) is equal to or greater than five.

3. The system according to claim 2, wherein the elementary radiating elements (1) are staggered one with respect to another with a spacing which is chosen so as to avoid the grating lobes.

4. The system according to claim 3, wherein the phase-shifting means are coded over three to eight bits.

5. The system according to claim 4, wherein the phase-shifting means (2) are of the ferrite type.

6. The system according to claim 3, wherein the phase-shifting means (2) are of the ferrite type.

7. The system according to claim 3, wherein, for a transmission frequency of 8000 MHz, the spacing between two elementary radiating elements is of the order of 19 mm.

8. The system according to claim 7, wherein the phase-shifting means are coded over three to eight bits.

9. The system according to claim 8, wherein the phase-shifting means (2) are of the ferrite type.

10. The system according to claim 7, wherein the phase-shifting means (2) are of the ferrite type.

11. The system according to claim 2, wherein the phase-shifting means are coded over three to eight bits.

12. The system according to claim 11, wherein the phase-shifting means (2) are of the ferrite type.

13. The system according to claim 2, wherein the phase-shifting means (2) are of the ferrite type.

14. The system according to claim 1, wherein the elementary radiating elements (1) are staggered one with respect to another with a spacing which is chosen so as to avoid the grating lobes.

15. The system according to claim 14, wherein, for a transmission frequency of 8000 MHz, the spacing between two elementary radiating elements is of the order of 19 mm.

16. The system according to claim 15, wherein the phase-shifting means are coded over three to eight bits.

17. The system according to claim 16, wherein the phase-shifting means (2) are of the ferrite type.

18. The system according to claim 15, wherein the phase-shifting means (2) are of the ferrite type.

19. The system according to claim 14, wherein the phase-shifting means are coded over three to eight bits.

20. The system according to claim 19, wherein the phase-shifting means (2) are of the ferrite type.

21. The system according to claim 14, wherein the phase-shifting means (2) are of the ferrite type.

22. The system according to claim 1, wherein the phase-shifting means are coded over three to eight bits.

23. The system according to claim 22, wherein the phase-shifting means (2) are of the ferrite type.

24. The system according to claim 1, wherein the phase-shifting means (2) are of the ferrite type.

25. The system according to claim 1, wherein the antenna comprises at least two in-line antennas and switching means for switching from one in-line antenna to another as a function of movement of the satellite.

26. The system according to claim 25, wherein the satellite movement is roll.

27. The system according to claim 1, wherein the antenna comprises motorization means for modifying the orientation of the line or lines of elementary radiating element so as to compensate for the potential movements of the satellite.

28. The system according to claim 27, wherein the satellite movement is roll.

29. An orbiting satellite comprising image-capture instruments and an antenna for retransmitting to the ground images collected by said image-capture instruments, said antenna comprising a plurality of elementary radiating antennas (1) of the type having a plurality of cords regularly distributed in a helix about one and the same generatrix of revolution as well as means for the equi-amplitude power supply of the various cords, the axes of said plurality of elementary antennas being aligned in a plane, and due to this plane configuration, emitting together an elongate beam, the plane in which the axes of said plurality of elementary antennas are distributed being perpendicular to the direction of the speed vector of the satellite, the antenna comprising means (2) for phase-shifting the power supply to said plurality of elementary antennas with phase shifts regularly distributed from one end of the antenna to the other in order to steer the elongate beam generated by the said elementary antennas.

* * * * *